US009649756B1

(12) United States Patent
Litzinger

(10) Patent No.: US 9,649,756 B1
(45) Date of Patent: May 16, 2017

(54) PNEUMATIC NAILER OUTRIGGER STABALIZING FOOT

(71) Applicant: William C. Litzinger, Springdale, AR (US)

(72) Inventor: William C. Litzinger, Springdale, AR (US)

( * ) Notice: Subject to any disclaimer, the term of this patent is extended or adjusted under 35 U.S.C. 154(b) by 855 days.

(21) Appl. No.: 13/766,236

(22) Filed: Feb. 13, 2013

Related U.S. Application Data

(60) Provisional application No. 61/633,533, filed on Feb. 13, 2012.

(51) Int. Cl.
*B25C 7/00* (2006.01)

(52) U.S. Cl.
CPC ..... *B25C 7/00* (2013.01)

(58) Field of Classification Search
CPC ..... B25C 1/04; B25C 1/00; B25C 7/00
USPC ..... 227/107, 119
See application file for complete search history.

(56) References Cited

U.S. PATENT DOCUMENTS 3,125,761 A * 3/1964 Adams ..... E04D 15/04 227/151
3,360,176 A * 12/1967 Gehl ..... B25C 7/00 227/148
3,554,246 A * 1/1971 Halstead ..... 81/434
4,346,831 A * 8/1982 Haytayan ..... B25C 1/001 227/130
4,523,646 A 6/1985 Doyle et al. ..... 173/15
5,267,682 A 12/1993 Okouchi ..... 227/151
5,628,445 A * 5/1997 Braddock et al. ..... 227/151
5,649,661 A * 7/1997 Masuno et al. ..... 227/8
5,662,257 A 9/1997 Mukoyama et al. ..... 227/8
6,095,392 A * 8/2000 Batts, Jr. ..... B25C 1/008 227/130
6,161,744 A 12/2000 Mukoyama et al. ..... 227/8
6,631,836 B2 * 10/2003 Dickhaut ..... B25C 7/00 227/128
7,882,994 B2 * 2/2011 Francescon ..... B25C 7/00 227/119
2002/0100787 A1 * 8/2002 Lin ..... 227/8
2005/0145670 A1 * 7/2005 Huang ..... E04F 21/22 227/148
2006/0261124 A1 * 11/2006 McGee ..... B25C 7/00 227/130
2006/0261129 A1 * 11/2006 McGee ..... B25C 7/00 227/148
2007/0257081 A1 * 11/2007 Dion ..... B25C 1/008 227/148
2009/0014495 A1 * 1/2009 Lin ..... E04F 21/22 227/123

(Continued)

*Primary Examiner* — Hemant M Desai
*Assistant Examiner* — Tanzim Imam
(74) *Attorney, Agent, or Firm* — Keisling & Pieper PLC; David B. Pieper

(57) ABSTRACT

The present invention is directed to a nail gun outrigger for stabilizing the roll, pitch, and yaw of a nail gun. The outrigger is connected to the distal end of the magazine away from the driving head. For the preferred embodiment, the outrigger includes one or more outriggers that extend perpendicular to the axis of the magazine with feet contacting the nailing surface to control the pitch, roll, and yaw of the nail gun position to obtain consistent perpendicular installation of elastomer sealing pneumatic nails into preformed roofing panels installed on a wooden frame or substrate.

5 Claims, 8 Drawing Sheets

(56) References Cited

U.S. PATENT DOCUMENTS

| | | | | |
|---|---|---|---|---|
| 2009/0084824 | A1* | 4/2009 | Jiang | 227/110 |
| 2009/0266867 | A1* | 10/2009 | Mina | B25C 7/00<br>227/151 |
| 2009/0277032 | A1* | 11/2009 | Grant | 33/645 |
| 2010/0187282 | A1* | 7/2010 | Crawford | B25C 7/00<br>227/140 |

* cited by examiner

PNEUMATIC NAILER OUTRIGGER STABALIZING FOOT

CROSS-REFERENCE TO RELATED APPLICATIONS

This application claims priority to of U.S. Provisional Application Ser. No. 61/633,533 filed by Litzinger on Feb. 13, 2012 entitled Foot Controlled Fastener Driving Tool and Method which is hereby incorporated by reference in its entirety.

STATEMENT REGARDING FEDERALLY SPONSORED RESEARCH OR DEVELOPMENT

Not Applicable.

REFERENCE TO A MICROFICHE APPENDIX

Not Applicable.

RESERVATION OF RIGHTS

A portion of the disclosure of this patent document contains material which is subject to intellectual property rights such as but not limited to copyright, trademark, and/or trade dress protection. The owner has no objection to the facsimile reproduction by anyone of the patent document or the patent disclosure as it appears in the Patent and Trademark Office patent files or records but otherwise reserves all rights whatsoever.

BACKGROUND OF THE INVENTION

1. Field of the Invention

The present invention relates to improvements in nail driving tools commonly referred to as nail guns, pneumatic nailers, or gas nailers. More particularly, the invention relates to improvements particularly suited for providing perpendicular installation of fasteners while minimizing the modification requirements of existing nail guns already in use. In particular, the present invention relates specifically to a flexible body suitable for installation over a vehicle mirror.

2. Description of the Known Art

As will be appreciated by those skilled in the art, pneumatic or gas powered nail guns are known in various forms. Patents disclosing information relevant to nail guns include: U.S. Pat. No. 4,523,646, issued to Doyle, et al. on June 18, entitled Fastener driving tool; U.S. Pat. No. 5,662,257, issued to Mukoyama, et al. on Sep. 2, 1997 entitled Nailing machine; U.S. Pat. No. 6,161,744, issued to Mukoyama, et al. on Dec. 19, 2000 entitled Fastener tool support; and U.S. Pat. No. 5,267,682, issued to Okouchi on Dec. 7, 1993 entitled Adjusting mechanism for adjusting position of abutting member in fastener driving device. Each of these patents is hereby expressly incorporated by reference in their entirety.

From these prior references it may be seen that these prior art patents are very limited in their teaching and utilization, and an improved outrigger stabilizing foot is needed to overcome these limitations.

SUMMARY OF THE INVENTION

The present invention is directed to a nail gun outrigger for stabilizing the roll, pitch, and yaw of a nail gun. The outrigger is connected to the distal end of the magazine away from the driving head. For the preferred embodiment, the outrigger includes one or more outriggers that extend perpendicular to the axis of the magazine with feet contacting the nailing surface to control the pitch, roll, and yaw of the nail gun position to obtain consistent perpendicular installation of elastomer sealing pneumatic nails into preformed roofing panels installed on a wooden frame or substrate. In one embodiment, the present invention is directed to an improved outrigger stabilizing foot using a magazine with an integrated slide rail, a magazine sliding block with a slide rail aperture, an outrigger extension bar with an elongated adjustment aperture and threaded foot apertures, a locking screw which engages the magazine sliding block and the bottom of the magazine, a locking nut which locks the outrigger extension bar to the magazine sliding block, and adjustable outrigger feet including non-marring contact feet, and a height adjustment mechanism including a threaded foot bolt and foot locking nut. Another embodiment provides for a magazine with an integrated slide rail, two upper magazine sliding arms defining a height adjustable slide rail aperture, an outrigger extension bar and outrigger feet. A still further embodiment teaches adding a cross arm locking bolt and arm locking nut. These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
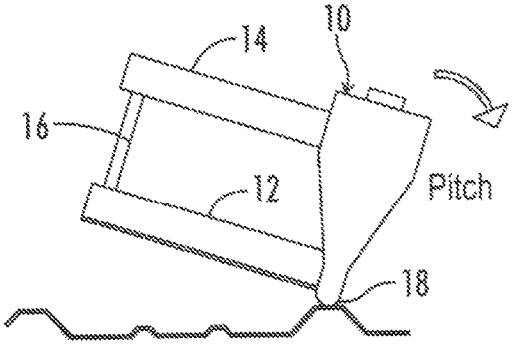
FIG. 1 (PRIOR ART)
FIG. 1 is a side view of a prior art nail gun showing a forward pitch in relation to the nailing surface.
Figure 2:
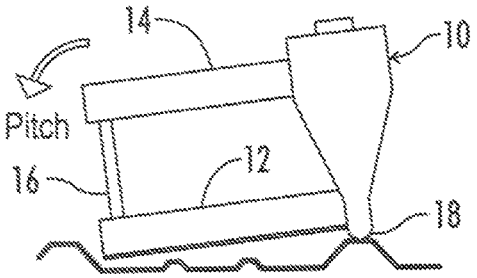
FIG. 2 (PRIOR ART)
FIG. 2 is a side view of a prior art nail gun showing a rearward pitch in relation to the nailing surface.
Figure 3:
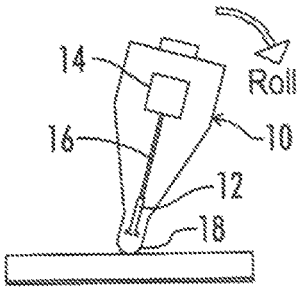
FIG. 3 (PRIOR ART)
FIG. 3 is a back view of a prior art nail gun showing a right side pitch in relation to the nailing surface.
Figure 4:
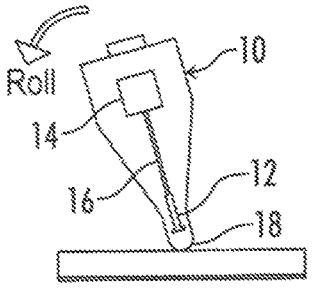
FIG. 4 (PRIOR ART)
FIG. 4 is a back view of a prior art nail gun showing a left side pitch in relation to the nailing surface.
Figure 5:
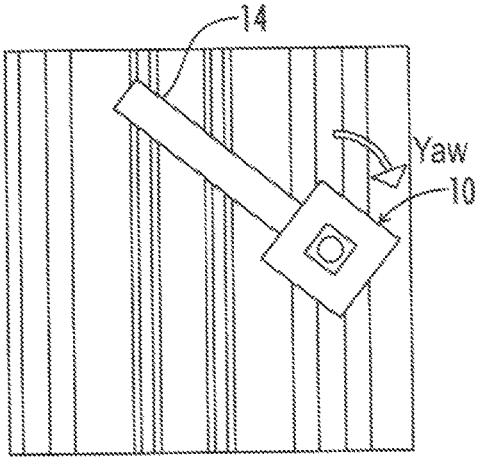
FIG. 5 (PRIOR ART)
FIG. 5 is a top view of a prior art nail gun showing a right pitch in relation to the nailing surface.
Figure 6:
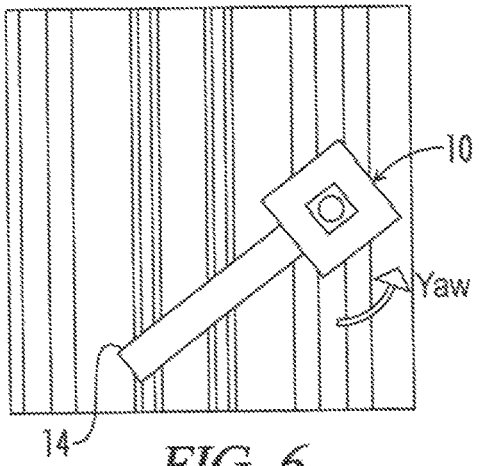
FIG. 6 (PRIOR ART)
FIG. 6 is a top view of a prior art nail gun showing a left pitch in relation to the nailing surface.
Figure 7:
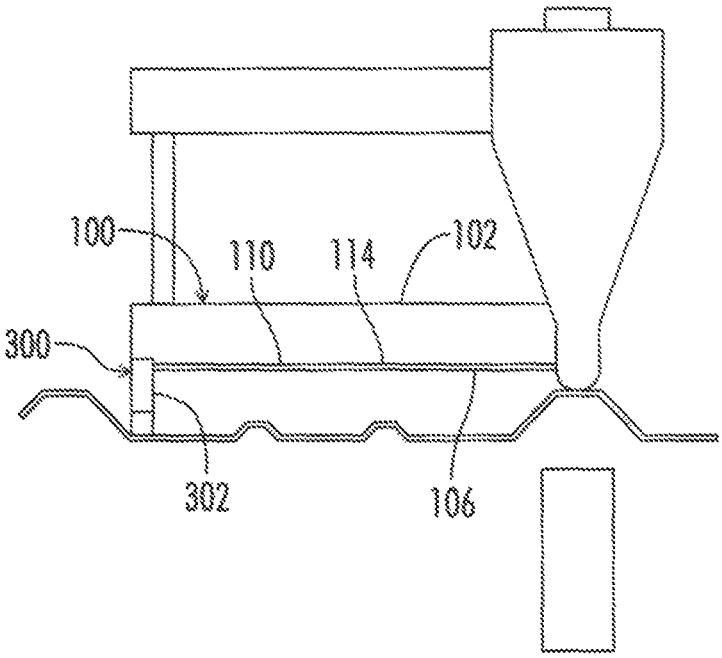
FIG. 7 is a right side view of a nail gun with the nail gun outrigger eliminating pitch and perpendicularly positioning the driving head on top of a ridge.
Figure 8:
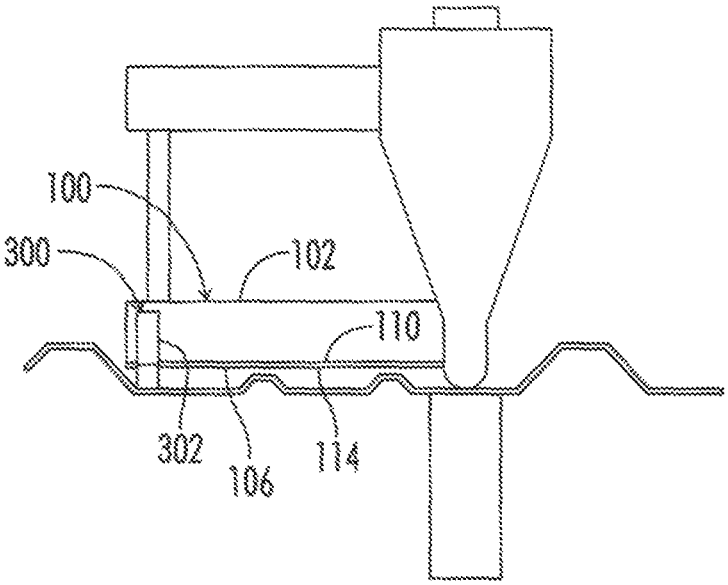
FIG. 8 is a right side view of a nail gun with the nail gun outrigger eliminating pitch and perpendicularly positioning the driving head in a valley.
Figure 9:
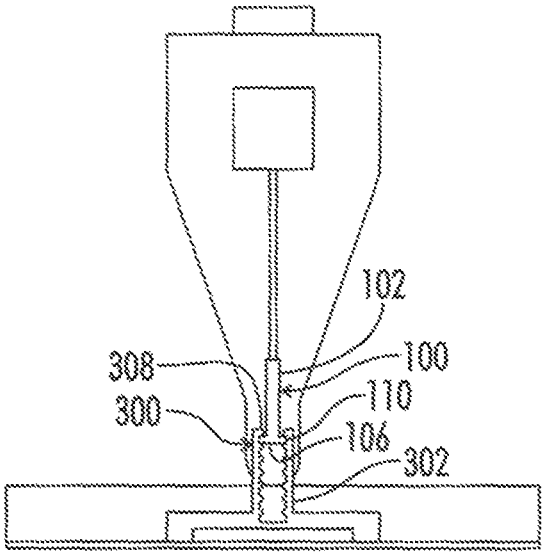
FIG. 9 is a back view showing the nail gun outrigger engaging the magazine slide rails with the fingers and eliminating roll of the nail gun using the feet.
Figure 10:
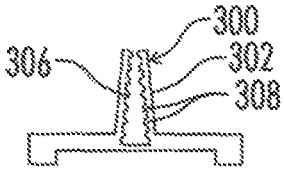
FIG. 10 is a back view of the nail gun outrigger showing an unclamped outrigger with spring bias for clamping.
Figure 11:
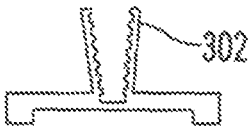
FIG. 11 is a back view of the nail gun outrigger showing an unclamped outrigger flexed to pass over the slide rails.
Figure 12:
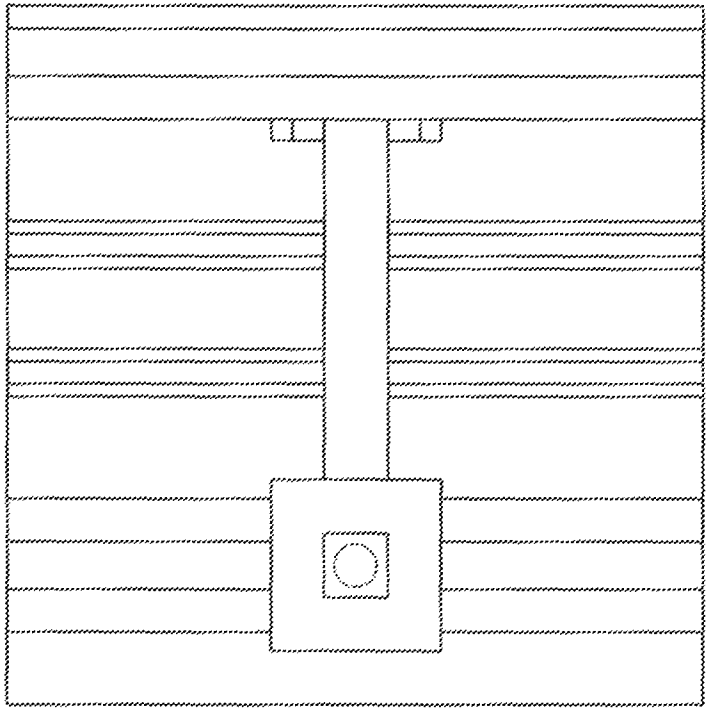
FIG. 12 is a top view showing how the nail gun outrigger can be used to eliminate yaw when positioning the nail gun.

As shown in FIGS. 7 through 16 of the drawings, the present invention is adapted for use with a nail gun 10 including a magazine 12, handle 14, handle support 16 and driving head 18. The improvements over the prior begin with a slide rail magazine 100.

As shown in FIGS. 7, 8, 9, 13, 14, 15, and 16, the slide rail magazine 100 includes a magazine body 102 defining a fastener aperture 104. The slide rail magazine includes a bottom 106 and a slide rail 110. The slide rail 110 can be of any shape or configuration that will hold, but in this embodiment is made with a square shape as a left rail extension 112 and a right rail extension 114.

A magazine sliding block 300 is used to engage the slide rail 110. The magazine sliding block 300 includes upper magazine sliding arms 302. Three different configurations are shown with two types of a single finger slide rail aperture 304 configuration shown in FIGS. 7 through 13 and a multiple finger slide rail aperture 306 configuration shown in FIGS. 14-16. Each type of configuration uses slide engagement fingers 308 to capture the slide rails 112, 114.

Figure 13:
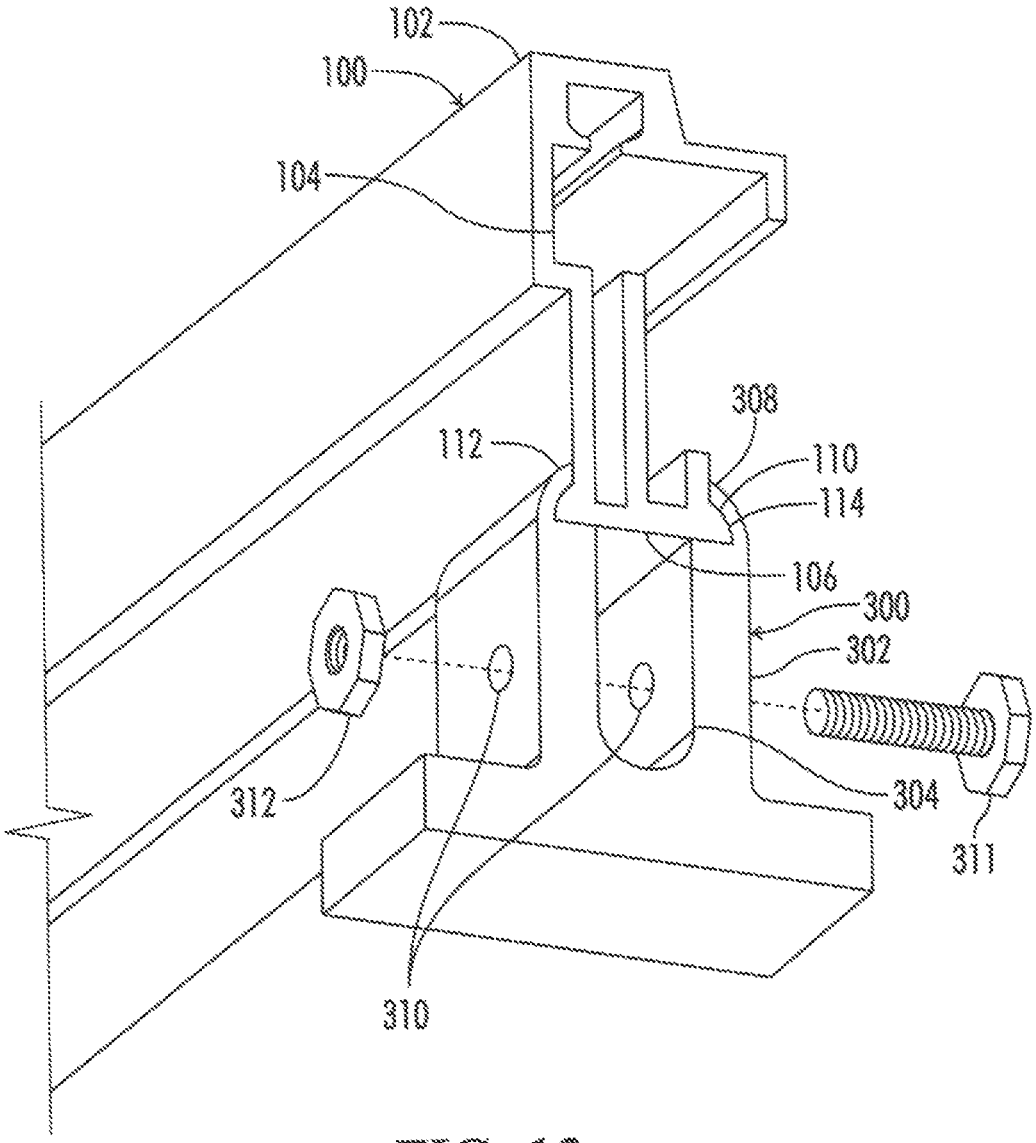
FIG. 13 is a perspective view of a nail gun outrigger showing the cross bolt engagement of the cross bolt apertures.

FIGS. 7 through 12 show a plastic version that uses the elastic properties of the material to clamp to the slide rails 112, 114. FIG. 13 shows the use of the cross bolt apertures 310 for the use of a cross arm locking bolt. 311 and arm locking nut 312 to provide the clamping force. The configuration of FIGS. 14-16 uses a slide locking aperture 314 and a locking screw 500 to clamp the block 300 to the bottom 106 of the magazine 100.

Figure 14:
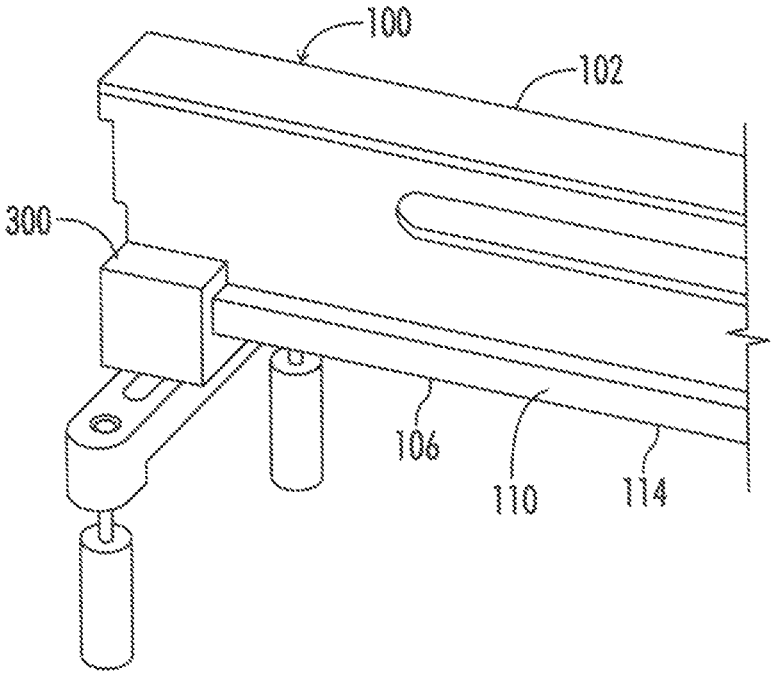
FIG. 14 is a perspective view of a nail gun outrigger showing the adjustable bar and foot.
Figure 15:
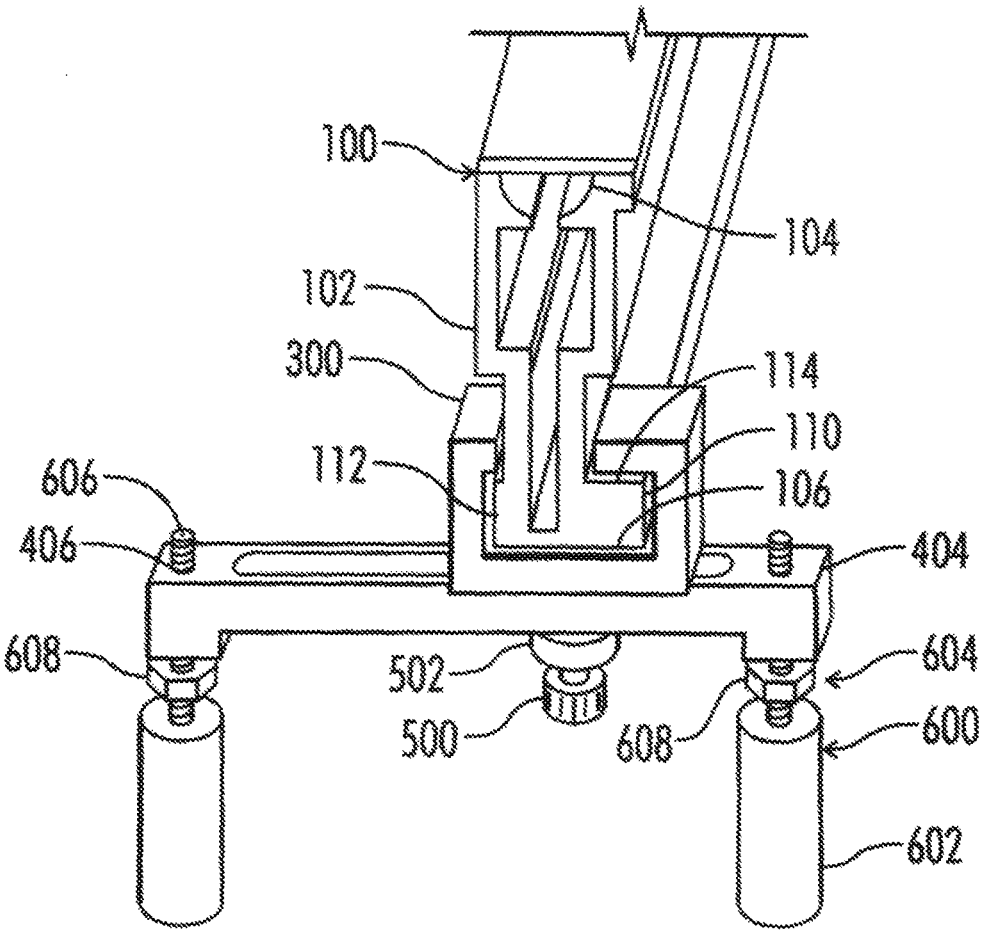
FIG. 15 is a perspective view of a nail gun outrigger showing the adjustable bar and foot.
Figure 16:
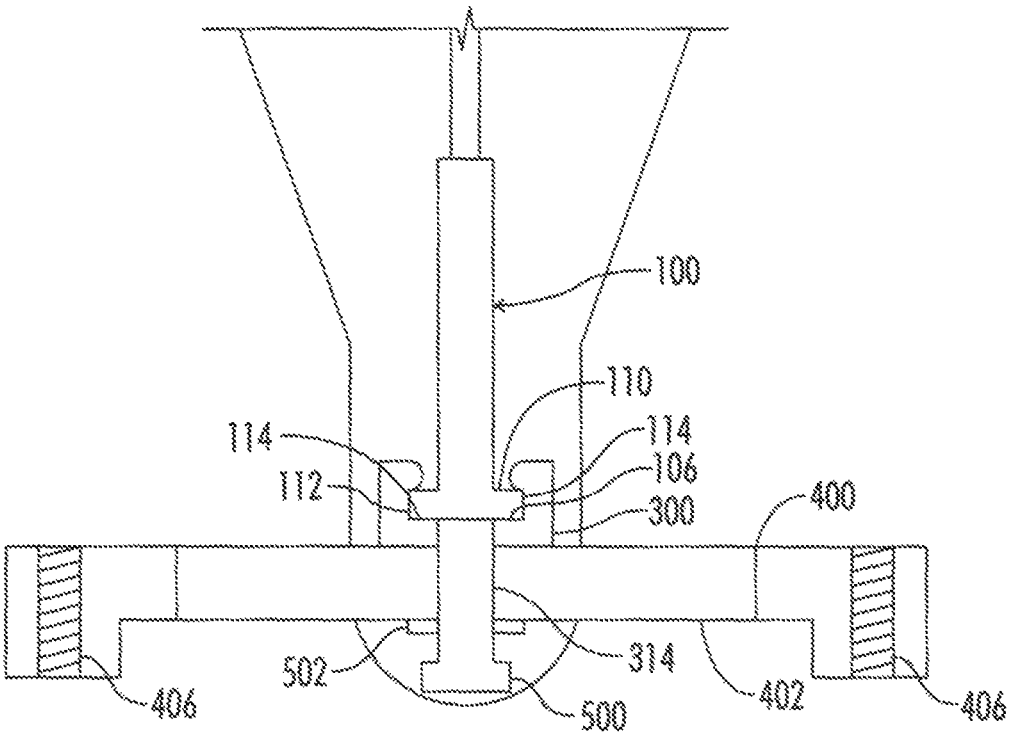
FIG. 16 is a cutaway view showing the engagement of the slide, adjustable bar, block to slide locking screw and bar to block locking nut.

Each configuration uses an outrigger extension bar 400 with it integrated into the configuration of FIGS. 7 through 13. FIGS. 14 through 16 show the outrigger extension bar 400 as a separate piece with the addition of the elongated adjustment aperture 402 for side to side adjustment.

Each configuration uses outrigger stabilizing foot 404 and FIGS. 14 through 16 show the addition of threaded foot apertures 406. In this configuration, a bar to block locking nut 502 is threaded onto the block to slide locking screw 500 to clamp the bar 400 to the slide block 300.

The threaded foot apertures 406 are used to add an adjustable outrigger foot 600. The adjustable outrigger foot 600 includes a non-marring contact foot 602 formed from a soft elastomer or plastic that will not scratch or harm the surface on which the nail gun 10 is being used while still providing durability. The adjustable outrigger foot 600 includes a height adjustment mechanism 604 including a threaded foot bolt 606 that is molded into the non-marring contact foot 602 and threads into the apertures 406 for vertical adjustment. A foot locking nut 608 is used for clamping the foot 600 in position.

Reference numerals used throughout the detailed description and the drawings correspond to the following elements:

Nail gun 10
Magazine 12
Handle 14
Support 16
Driving head 18
integrated slide rail magazine 100
body 102
fastener aperture 104
bottom 106
slide rail 110
a left rail extension 112
a right rail extension 114
magazine sliding block 300
upper magazine sliding arms 302
single finger slide rail aperture 304
multiple finger slide rail aperture 306
slide engagement fingers 308
cross bolt apertures 310
cross arm locking bolt 311
arm locking nut 312
slide locking aperture 314
outrigger extension bar 400
elongated adjustment aperture 402
outrigger stabilizing foot 404
threaded foot apertures 406
locking screw 500
locking nut 502
adjustable outrigger foot 600
non-marring contact foot 602
height adjustment mechanism 604
threaded foot bolt 606
foot locking nut 608

From the foregoing, it will be seen that this invention is well adapted to obtain all the ends and objects herein set forth, together with other advantages which are inherent to the structure. It will also be understood that certain features and subcombinations are of utility and may be employed without reference to other features and subcombinations. This is contemplated by and is within the scope of the claims. Many possible embodiments may be made of the invention without departing from the scope thereof. Therefore, it is to be understood that all matter herein set forth or shown in the accompanying drawings is to be interpreted as illustrative and not in a limiting sense.

When interpreting the claims of this application, method claims may be recognized by the explicit use of the word 'method' in the preamble of the claims and the use of the 'ing' tense of the active word. Method claims should not be interpreted to have particular steps in a particular order unless the claim element specifically refers to a previous element, a previous action, or the result of a previous action. Apparatus claims may be recognized by the use of the word 'apparatus' in the preamble of the claim and should not be interpreted to have 'means plus function language' unless the word 'means' is specifically used in the claim element. The words 'defining,' 'having,' or 'including' should be interpreted as open ended claim language that allows additional elements or structures. Finally, where the claims recite "a" or "a first" element of the equivalent thereof, such claims should be understood to include incorporation of one or more such elements, neither requiring nor excluding two or more such elements.

What is claimed is:

1. An outrigger stabilizing foot apparatus for a nail gun, the apparatus comprising:

an integrated slide rail magazine including a magazine body defining a fastener aperture and a bottom;

a slide rail with at least on rail extension extending from the magazine body; and a magazine sliding block including upper magazine sliding arms defining a slide rail aperture which captures the slide rail, the magazine sliding arms extending upward past the bottom to opposite sides of the fastener aperture; and a first slide engagement finger, a second slide engagement finger positioned above the first slide engagement finger, and a third slide engagement finger positioned above the second slide engagement finger along the magazine sliding arms.

2. An outrigger stabilizing foot apparatus for a nail gun, the apparatus comprising:

an integrated slide rail magazine including a magazine body defining a fastener aperture and a bottom;

a slide rail with at least one rail extension extending from the magazine body; and a magazine sliding block including upper magazine sliding arms defining a slide rail aperture which captures the slide rail, the magazine sliding arms extending upward past the bottom to opposite sides of the fastener aperture;

cross bolt apertures defined by the upper magazine sliding arms; and a cross arm locking bolt and nut engaging the cross bolt apertures.

3. An outrigger stabilizing foot apparatus for a nail gun, the apparatus comprising:

an integrated slide rail magazine including a magazine body defining a fastener aperture and a bottom;

a slide rail with at least one rail extension extending from the magazine body; and a magazine sliding block including upper magazine sliding arms defining a slide rail aperture which captures the slide rail, the magazine sliding arms extending upward past the bottom to opposite sides of the fastener aperture;

an outrigger extension bar including an elongated adjustment aperture;

an adjustable outrigger foot; and wherein the outrigger extension bar includes an outrigger stabilizing foot defining a threaded foot aperture.

4. The apparatus of claim 3, wherein the adjustable outrigger foot further comprising a non-marring contact foot.

5. The apparatus of claim 3, further comprising:

a height adjustment mechanism including a threaded foot bolt and a foot locking nut.

* * * * *